US010879633B2

(12) United States Patent
Fu et al.

(10) Patent No.: US 10,879,633 B2
(45) Date of Patent: Dec. 29, 2020

(54) CONNECTOR HOUSING AND ELECTRICAL CONNECTOR

(71) Applicant: Tyco Electronics (Shanghai) Co. Ltd., Shanghai (CN)

(72) Inventors: Xiaozhi Fu, Shanghai (CN); Ming Shi, Shanghai (CN); Hongtao Jiang, Shanghai (CN); Yong Yang, Shanghai (CN); Yuquan Chen, Shanghai (CN); Leshu Yang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/220,079

(22) Filed: Dec. 14, 2018

(65) Prior Publication Data

US 2019/0190172 A1 Jun. 20, 2019

(30) Foreign Application Priority Data

Dec. 15, 2017 (CN) ..... 2017 2 1763058 U

(51) Int. Cl.

| | |
|---|---|
| ***H01R 12/57*** | (2011.01) |
| ***H01R 13/24*** | (2006.01) |
| ***H01R 12/70*** | (2011.01) |
| ***H01R 43/20*** | (2006.01) |
| ***H01R 12/72*** | (2011.01) |
| ***H01R 13/502*** | (2006.01) |
| ***H01R 12/79*** | (2011.01) |
| ***H01R 12/71*** | (2011.01) |

(52) U.S. Cl.

CPC ..... *H01R 12/57* (2013.01); *H01R 12/7005* (2013.01); *H01R 12/7029* (2013.01); *H01R 12/712* (2013.01); *H01R 12/722* (2013.01); *H01R 12/79* (2013.01); *H01R 13/24* (2013.01); *H01R 13/502* (2013.01); *H01R 43/20* (2013.01)

(58) Field of Classification Search

CPC ..... H01R 12/00; H01R 12/52; H01R 12/57; H01R 12/718; H01R 12/7005; H01R 12/722; H01R 13/24; H01R 13/502; H01R 43/20

USPC ..... 439/78

See application file for complete search history.

(56) References Cited

U.S. PATENT DOCUMENTS 4,509,811 A * 4/1985 Amano ..... H01R 12/79 439/495
4,668,040 A * 5/1987 Matsuzaki ..... H01R 12/7029 439/557
5,257,948 A * 11/1993 Peterson ..... H01R 12/7029 439/571

(Continued)

*Primary Examiner* — Peter G Leigh
(74) *Attorney, Agent, or Firm* — Barley Snyder

(57) ABSTRACT

A connector housing comprises a body, an outside surface of the body having a pair of opposite mounting surfaces, a first contact surface, and a second contact surface, and a mounting portion disposed on each of the mounting surfaces. The mounting surfaces, the first contact surface and the second contact surface are perpendicular to each other. A distance between the mounting portion and the first contact surface is equal to a distance between the mounting portion and the second contact surface. The connector housing is interchangeably mounted with the first contact surface on a circuit board or with the second contact surface on the circuit board by a same mounting mechanism engaging the mounting portion.

20 Claims, 12 Drawing Sheets

(56) References Cited

U.S. PATENT DOCUMENTS

| | | | | |
|---|---|---|---|---|
| 5,803,765 | A * | 9/1998 | Peloza | H01R 12/7029 439/567 |
| 6,022,244 | A * | 2/2000 | Chiu | H01R 12/707 439/570 |
| 6,053,767 | A * | 4/2000 | Copper | H01R 12/7029 439/567 |
| 6,860,765 | B1 * | 3/2005 | Spink, Jr. | H01R 12/716 439/680 |
| 7,083,435 | B2 * | 8/2006 | Lohr | H01R 12/57 439/79 |
| 9,312,628 | B2 * | 4/2016 | Lappoehn | H01R 12/707 |

* cited by examiner

CONNECTOR HOUSING AND ELECTRICAL CONNECTOR

CROSS-REFERENCE TO RELATED APPLICATION

This application claims the benefit of the filing date under 35 U.S.C. § 119(a)-(d) of Chinese Patent Application No. 201721763058.7, filed on Dec. 15, 2017.

FIELD OF THE INVENTION

The present invention relates to an electrical connector and, more particularly, to a connector housing of an electrical connector.

BACKGROUND

In electrical equipment such as a lighting lamp, a refrigerator, a washing machine, etc., two cables are typically connected to a plug connector and a socket connector, respectively, so as to facilitate electrical connection of the two cables. The electrical connection of the two cables is achieved by mating between the plug connector and the socket connector.

Both the existing plug connector and the existing socket connector include a housing and a connection terminal mounted in the housing. It is generally necessary to secure the socket connector to a mounting bracket, such as a circuit board. The socket connector is mounted on the mounting bracket horizontally or vertically with respect to the mounting bracket, depending on the application, and is mounted by surface mount technology (SMT) or dual in-line package (DIP) technology. The housing and a mounting mechanism of the socket connector must be manufactured in different shapes and configurations so as to meet different manners of mounting on the mounting bracket, which reduces the versatility of the housing and increases the manufacturing cost of the electrical connector.

SUMMARY

A connector housing comprises a body, an outside surface of the body having a pair of opposite mounting surfaces, a first contact surface, and a second contact surface, and a mounting portion disposed on each of the mounting surfaces. The mounting surfaces, the first contact surface and the second contact surface are perpendicular to each other. A distance between the mounting portion and the first contact surface is equal to a distance between the mounting portion and the second contact surface. The connector housing is interchangeably mounted with the first contact surface on a circuit board or with the second contact surface on the circuit board by a same mounting mechanism engaging the mounting portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
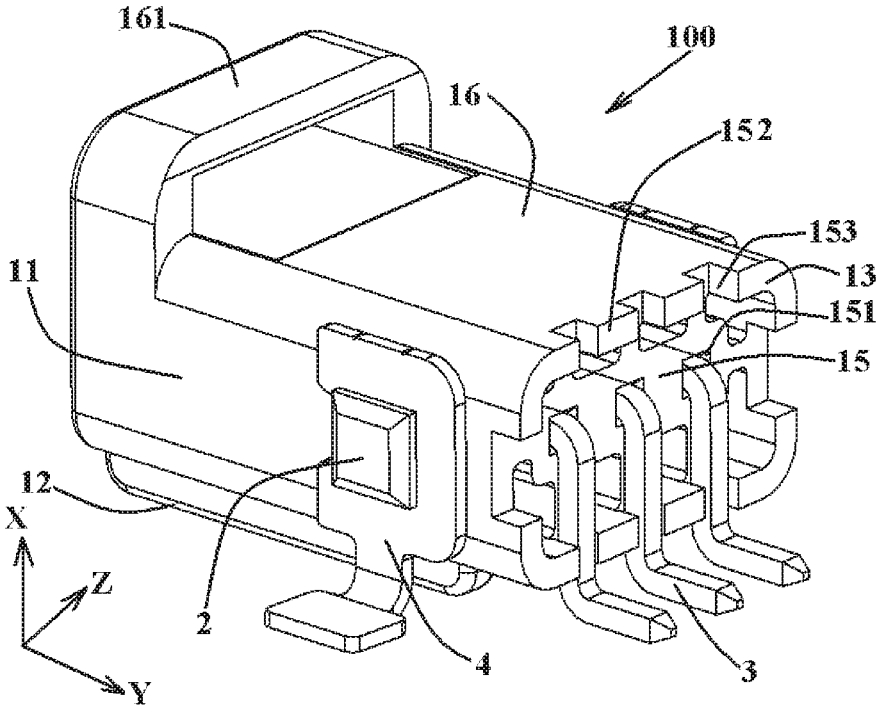
FIG. 1 is a perspective view of an electrical connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Figure 2:
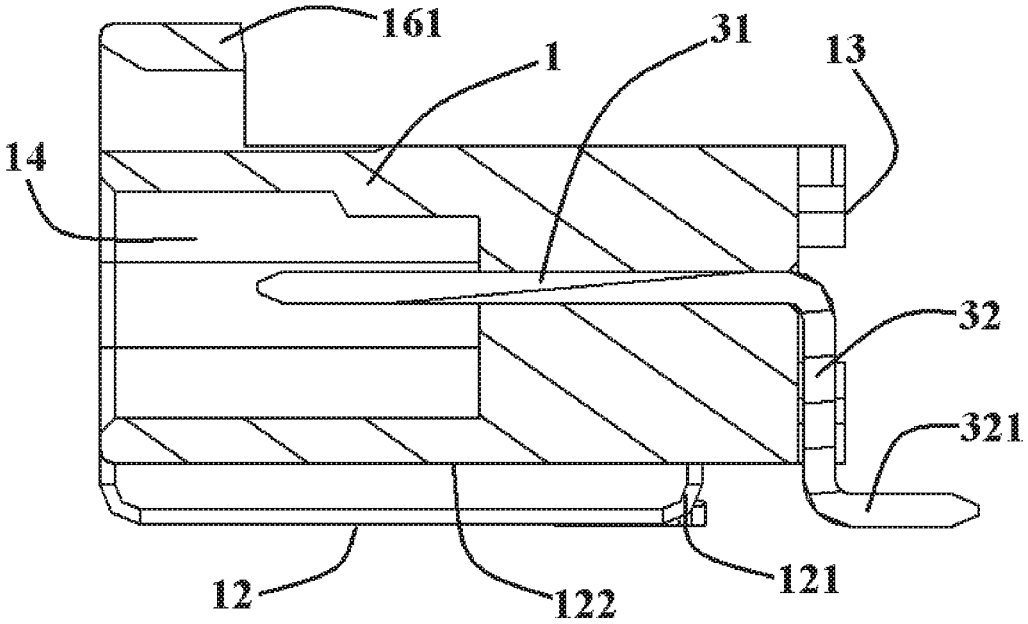
FIG. 2 is a sectional side view of the electrical connector.
Figure 3:
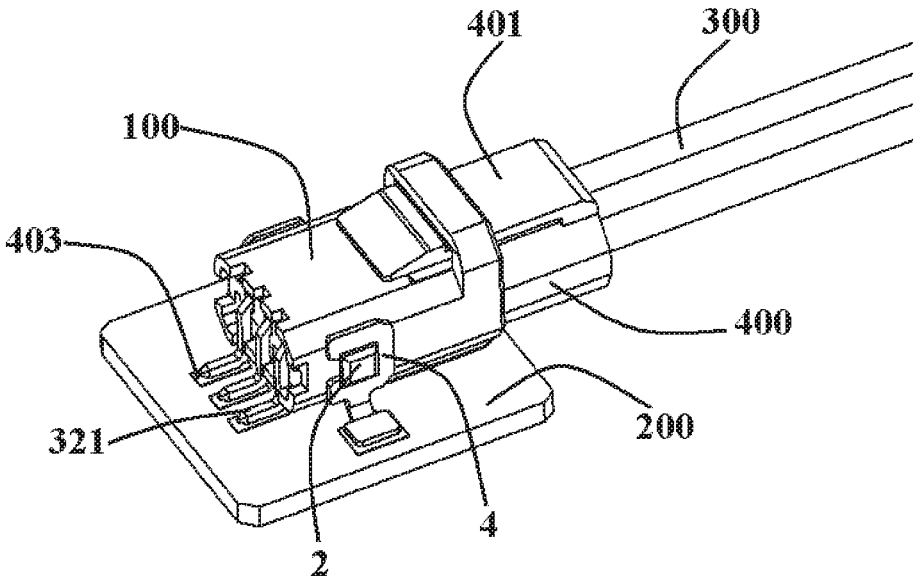
FIG. 3 is a perspective view of the electrical connector and a mating connector mounted on a circuit board.

An electrical connector 100 according to an embodiment is shown in FIGS. 1-3. In the shown embodiment, the electrical connector 100 is a socket connector mounted on a support frame, for example, a circuit board 200. The electrical connector 100 is engaged with a mating connector 400, a plug connector in the shown embodiment, which is electrically connected with a cable 300. The cable 300 powers or transmits electrical signals to a circuitry arranged in the circuit board 200 when the electrical connector 100 is mated with the mating connector 400.

The electrical connector 100, as shown in FIGS. 1-4, comprises a connector housing 10, at least one connection terminal 3 formed of a conductive material, and at least one mounting mechanism 4. In the shown embodiment, the connector housing 10 is formed of an insulative plastic material. In the shown embodiment, the electrical connector 100 has three connection terminals 3, each of which are formed of a copper or a stainless steel, and two mounting mechanisms 4, each of which are formed of a copper of a stainless steel.

As shown in FIGS. 1-5, the connector housing 10 includes a body 1 and a pair of mounting portions 2. The body 1 has a substantially cuboid shape. An outside surface of the body 1 has a pair of opposite mounting surfaces 11, a first contact surface 12, and a second contact surface 13. The first contact surface 12 is adapted to contact the circuit board 200 in a first mounting manner of the connector housing 10 and the second contact surface 13 is adapted to contact the circuit board 200 in a second mounting manner of the connector housing 10.

As shown in FIGS. 1 and 2, the mounting surfaces 11, the first contact surface 12, and the second contact surface 13 are perpendicular to each other. In a three-dimensional coordinate system, the mounting surfaces 11 are located in the XY plane parallel to a side surface of the electrical connector 100, the first contact surface 12 is located in the YZ plane parallel to a horizontal surface of the electrical connector 100, and the second contact surface 13 is located in the ZX plane parallel to a bottom wall of the electrical connector 100.

Figure 4:
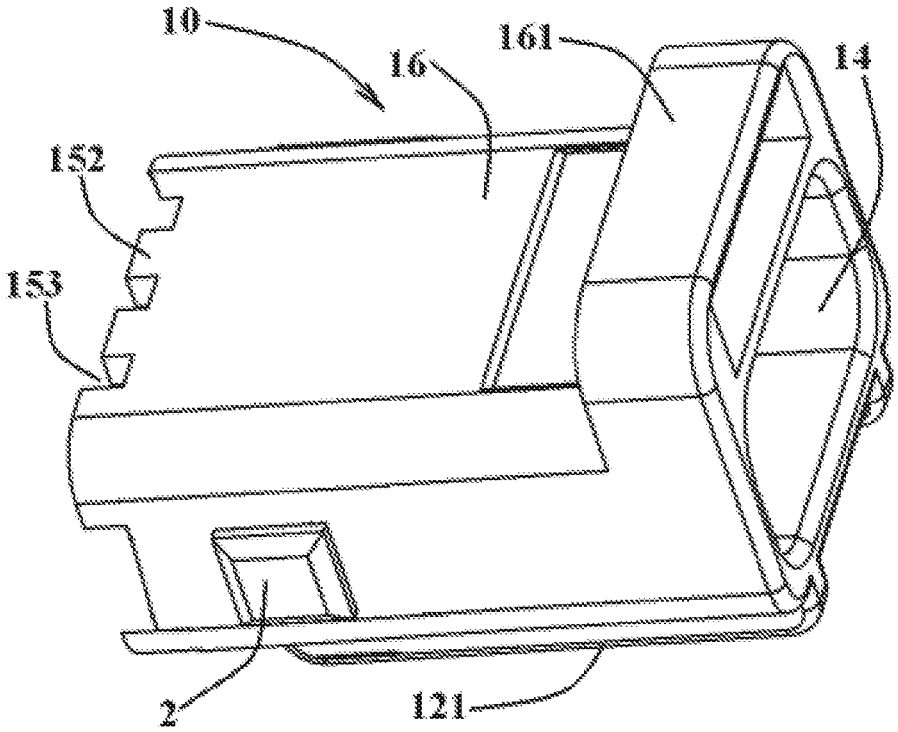
FIG. 4 is a perspective view of a connector housing.

The two mounting portions 2, as shown in FIGS. 1, 3, and 4, are each arranged on one of the mounting surfaces 11. The three connection terminals 3 extend into the connector housing 10 through the bottom wall in a direction perpendicular to the second contact surface 13. The two mounting mechanisms 4 are each engaged with one of the mounting portions 2 to interchangeably mount the electrical connector 100 with the first contact surface 12 on the circuit board 200 in the first mounting manner or with the second contact surface 13 on the circuit board 200 in the second mounting manner. As shown in FIG. 1, a distance between the mounting portions 2 and the first contact surface 12 in a height direction X is substantially the same as a distance between the mounting portions 2 and the second contact surface 13 in a longitudinal direction Y. The height direction X is perpendicular to the longitudinal direction Y, and both the height direction X and the longitudinal direction Y are perpendicular to a width direction Z. The electrical connector 100 may therefore be mounted on the circuit board 200 horizontally or vertically using the same mounting mechanism 4, as described in greater detail below.

The body 1, as shown in FIGS. 1, 2, and 4, has a receiving portion 14 adapted to receive an insertion portion of the mating connector 400. A bottom wall 15 of the receiving portion 14 parallel to the second contact surface 13 has a plurality of through holes 151 through which the connection terminals 3 extend into the receiving portion 14 to be electrically connected to mating terminals of the mating connector 400 inserted into the receiving portion 14.

Figure 8:
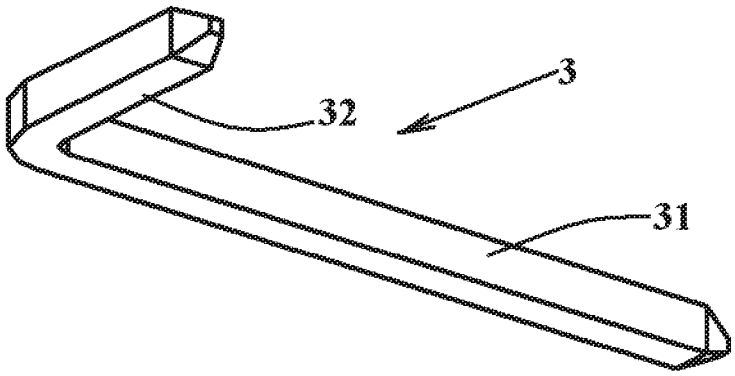
FIG. 8 is a perspective view of a connection terminal of the electrical connector.

As shown in FIGS. 1, 2, and 8, each of the connection terminals 3 includes an insertion portion 31 extending into the receiving portion 14 of the connector housing 10 through the through hole 151 and an extension portion 32 integrally connected to the insertion portion 31 and electrically connected to electrical contacts on the circuit board 200. In an embodiment, the connector housing 10 is over-molded directly onto the connection terminals 3 by an injection molding process. In another embodiment, the connection terminals 3 are inserted into the connector housing 10 after the connector housing 10 is made. The connection terminals 3 may be formed as a straight line shape, a substantially L-shape or a substantially Z-shape depending on the required mounting postures.

Figure 5:
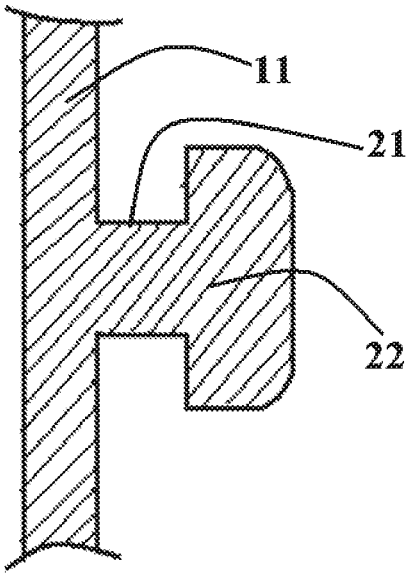
FIG. 5 is a sectional side view of a mounting portion of the connector housing.

As shown in FIGS. 4 and 5, the mounting portion 2 includes a connection portion 21 integrally connected to the mounting surface 11 at a first end of the connection portion 21. A distance between the connection portion 21 and the first contact surface 12 is substantially the same as a distance between the connection portion 21 and the second contact surface 13. The mounting portion 2 includes a holding portion 22 protruding radially outward from a second end of the connection portion 21 opposite to the first end of the connection portion 21. When the mounting mechanism 4 is mounted on the connection portion 21, the holding portion 22 prevents the mounting mechanism 4 from being disengaged from the connection portion 21.

Figure 6:
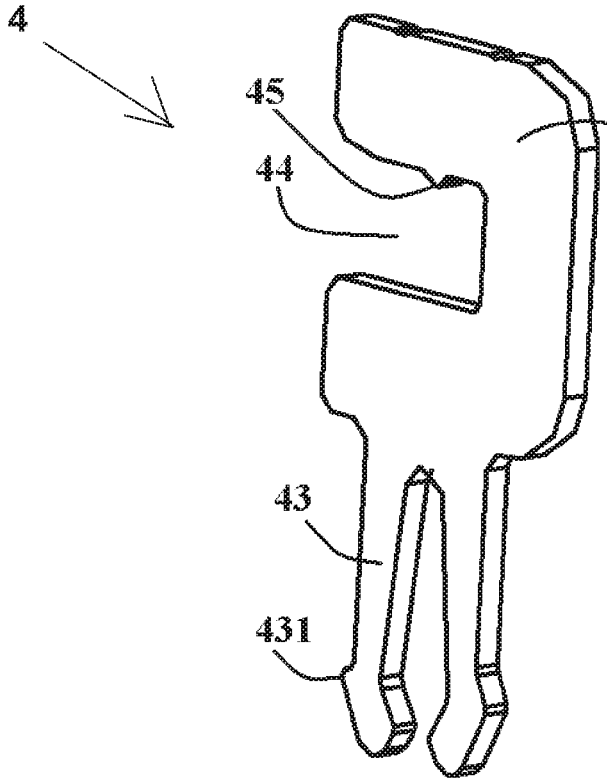
FIG. 6 is a perspective view of a mounting mechanism of the electrical connector according to an embodiment.

The mounting mechanism 4, in the embodiment shown in FIG. 6, includes a mating mounting portion 41 adapted to engage with the connection portion 21 and a fixing portion 43 connected with the mating mounting portion 41 and configured to be connected to the circuit board 200. The fixing portion 43 includes a pair of insertion portions extending in parallel from the mating mounting portion 41. The insertion portions of the fixing portion 43 are inserted into a socket of the circuit board 200. An end of each of the insertion portions has a laterally protruding blocking portion 431 engaging an inner wall of the socket in the circuit board 200 to prevent the insertion portion 43 from being detached from the circuit board 200.

Figure 7:
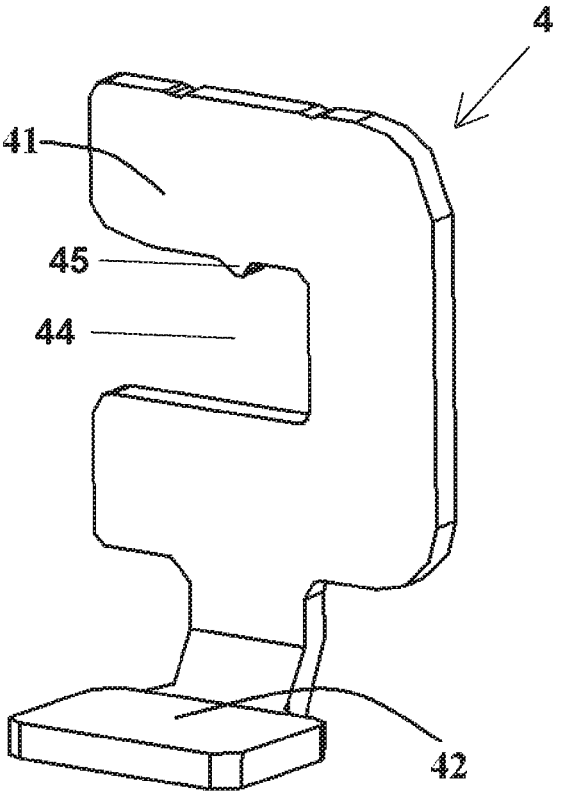
FIG. 7 is a perspective view of a mounting mechanism according to another embodiment.

The mounting mechanism 4, as shown in the embodiment of FIG. 7, includes the mating mounting portion 41 adapted to engage with the connection portion 21 of the mounting portion 2 and a fixing portion 42 integrally connected with the mating mounting portion 41 and configured to be connected to the circuit board 200. The mating mounting portion 41 has an engagement groove 44 with a lateral opening, the engagement groove 44 being constructed to receive the connection portion 21 in different directions. The engagement groove 44 has a protrusion 45 engaged with the connection portion 21 to prevent the mating mounting portion 41 from being detached from the connection portion 21. In the embodiment shown in FIG. 7, the fixing portion 42 is a surface mounting portion 42 extending perpendicular to the mating mounting portion 41. The surface mounting portion 42 may be mounted on a pad of the circuit board 200 by surface mount technology (SMT), thereby mechanically mounting the electrical connector 100 on the circuit board 200.

As shown in FIGS. 1 and 4, a skirt 152 is provided outside of the bottom wall 15 of the connector housing 10. A free end of the skirt 152 forms the second contact surface 13 to be brought into contact with the circuit board 200. A plurality of grooves 153 formed in the skirt 152 allow the connection terminals 3 to pass therethrough. A plurality of protrusions 121 are formed on a first side wall 122 of the body 1, as shown in FIG. 2, and ends of the protrusions 121 form the first contact surface 12. A thickness of the lower side wall of the body 1 of the connector housing 10 may be as thick as that of the upper side wall by providing the protrusions 121, and the protrusions 121 may increase the elasticity between the connector housing 100 and the circuit board 200 and reduce vibration. In another embodiment, the outer surface of the first side wall 122 is the first contact surface 12.

As shown in FIGS. 1-4, in an embodiment, an engagement portion 161 is formed on a second side wall 16 opposite to the first side wall 122 and engages with an engagement arm 401 of the mating connector 400. When the electrical connector 100 is engaged with the mating connector 400, the engagement arm 401 is snap-fitted with the engagement portion 161 to lock the electrical connector 100 and the mating connector 400 together, preventing the electrical connector 100 and the mating connector 400 from disengaging.

An embodiment in which the electrical connector 100 is mounted horizontally on the circuit board 200 in a first mounting manner is shown in FIG. 3. The electrical connector 100 is mounted on the circuit board 200 by SMT. In the embodiment of FIG. 3, the connection terminal 3 has a generally Z-shape, and the extension portion 32 of the connection terminal 3 has a soldered end 321 soldered to the electrical contacts 403 on the circuit board 200.

Each of the electrical connectors 500, 600, and 700 described below with respect to FIGS. 9-18 has the same connector housing 10 as the electrical connector 100 and the same structural elements as the electrical connector 100 unless otherwise described, but a mounting manner of each of the electrical connectors 100, 500, 600, and 700 is different. The mounting manner includes a type of mounting, such as SMT or dual in-line package (DIP) technology, and an orientation of mounting the connector housing 10 with respect to the circuit board 200, such as horizontal or vertical. For example, the mounting manner of the electrical connector 100 is SMT in a horizontal orientation as described above.

Figure 9:
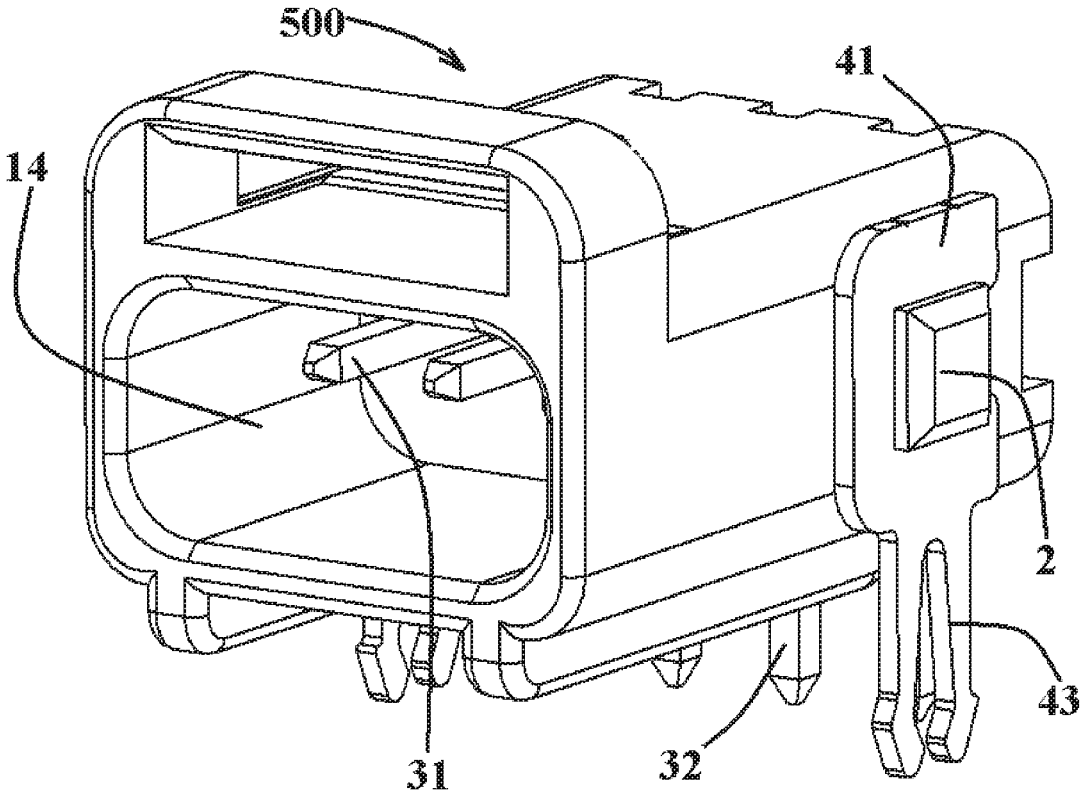
FIG. 9 is a perspective view of an electrical connector in another mounting manner.
Figure 10:
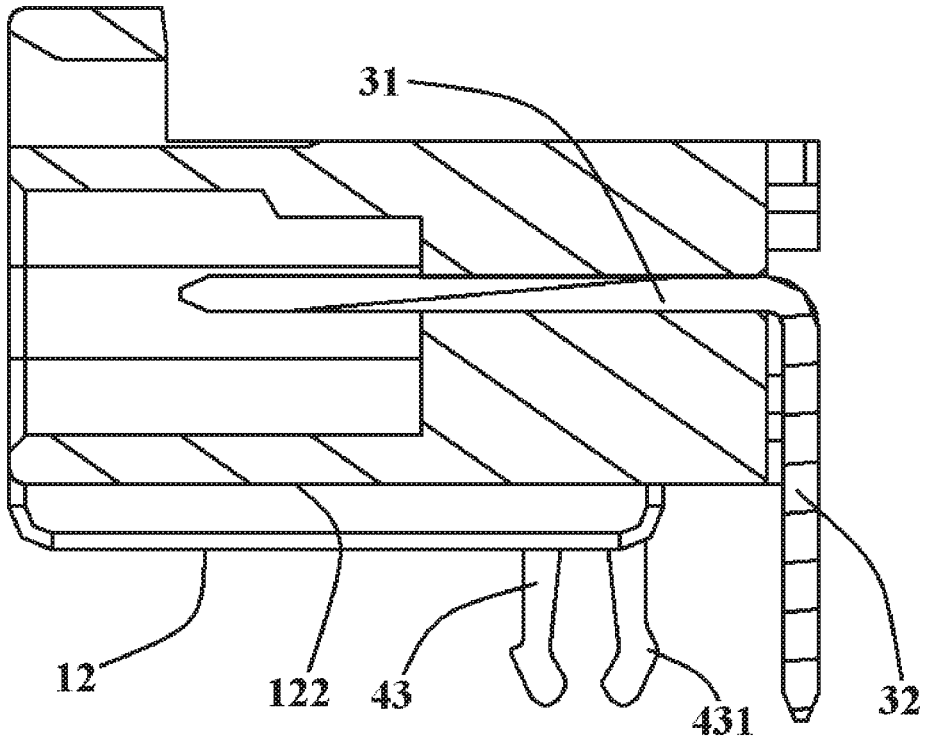
FIG. 10 is a sectional side view of the electrical connector of FIG. 9.
Figure 11:
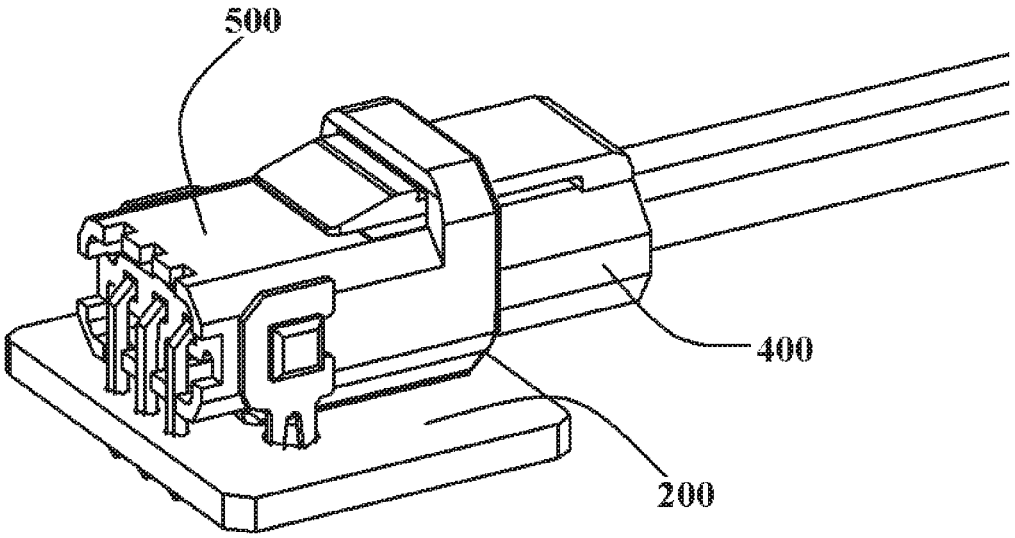
FIG. 11 is a perspective view of the electrical connector of FIG. 9 and the mating connector mounted on a circuit board.

An electrical connector 500 according to another embodiment is shown in FIGS. 9-11. The electrical connector 500 is horizontally mounted on the circuit board 200 by DIP technology and the first contact surface 12 of the connector housing 10 is in contact with the circuit board 200. In this mounting example, the connection terminal 3 has a substantially L-shape, an end of the extension 32 of the connection terminal 3 is inserted into the terminal inserting hole of the circuit board 200, forming an electrical connection with a corresponding mating contact in the circuit board 200. The insertion portion 43 of the mounting mechanism 4 is inserted into the socket of the circuit board 200 to mechanically mount the electrical connector 500 to the circuit board 200.

Figure 12:
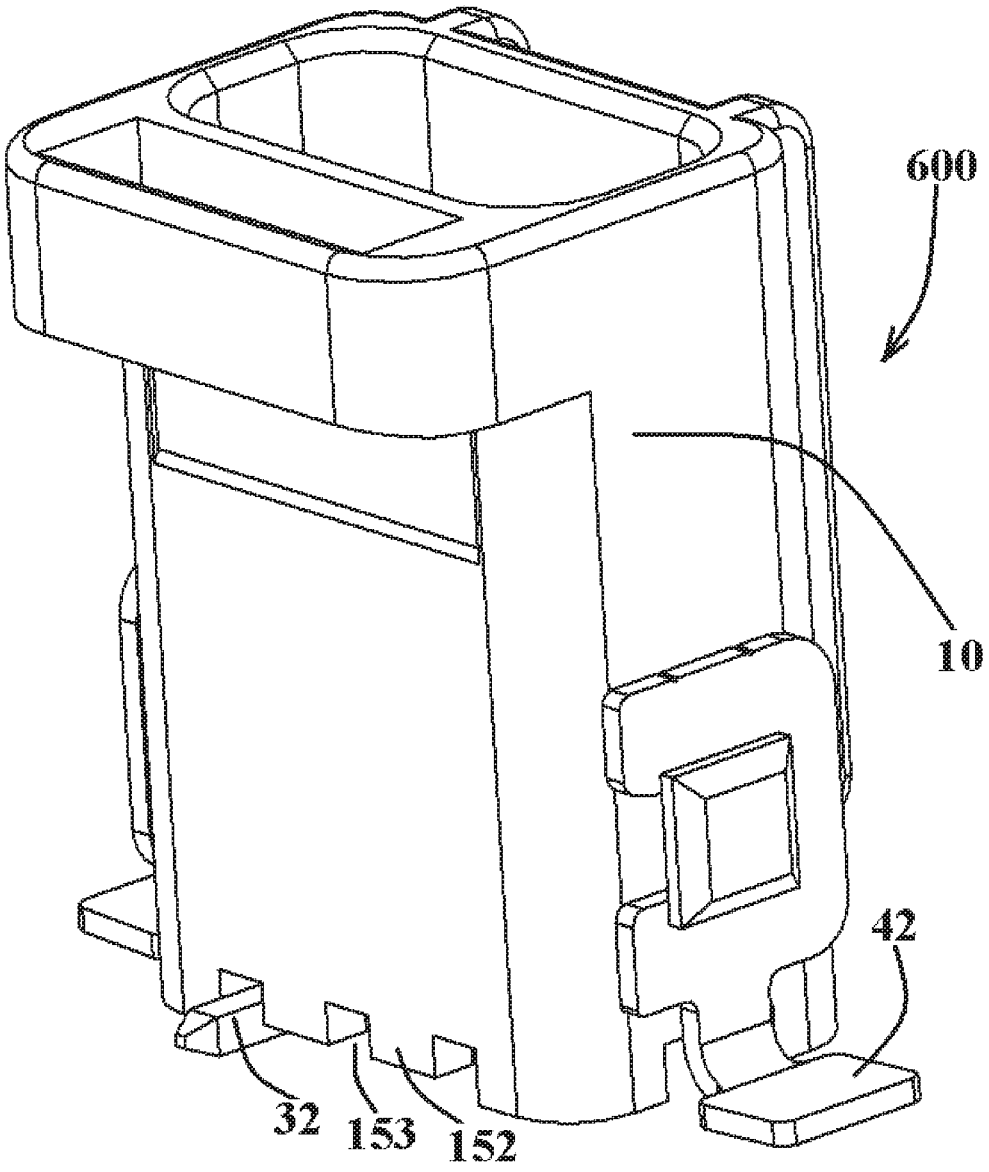
FIG. 12 is a perspective view of the electrical connector in another mounting manner.
Figure 13:
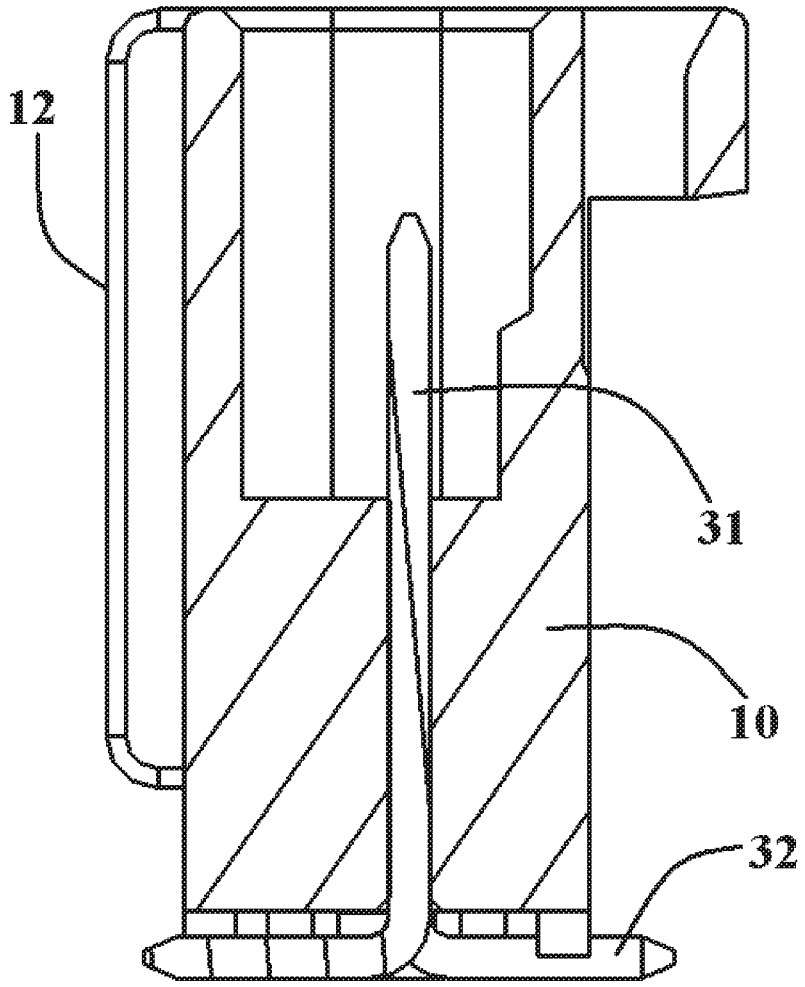
FIG. 13 is a sectional side view of the electrical connector of FIG. 12.
Figure 14:
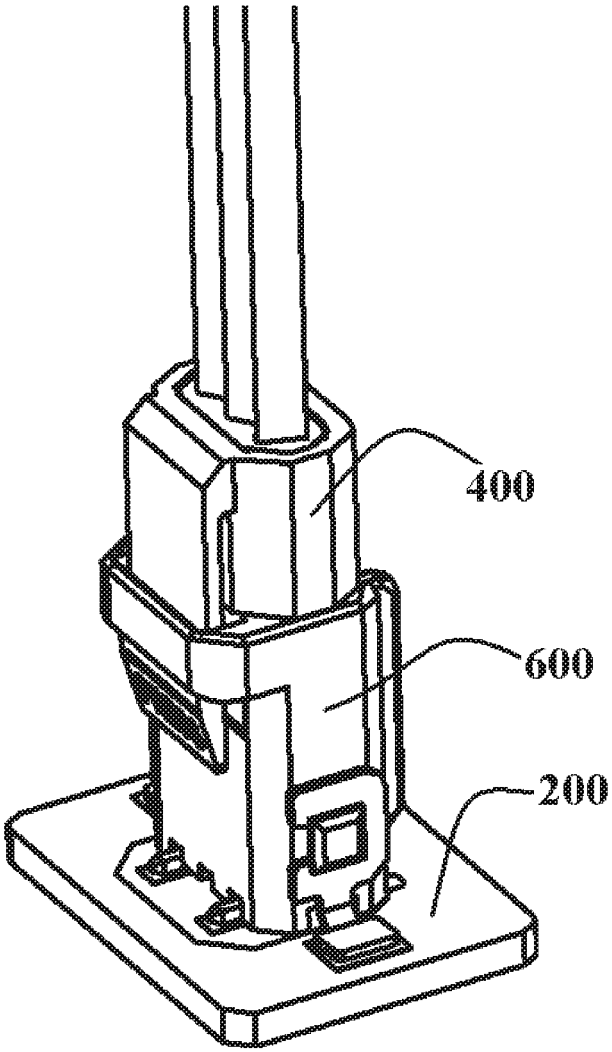
FIG. 14 is a perspective view of the electrical connector of FIG. 12 and the mating connector mounted on a circuit board.
Figure 15:
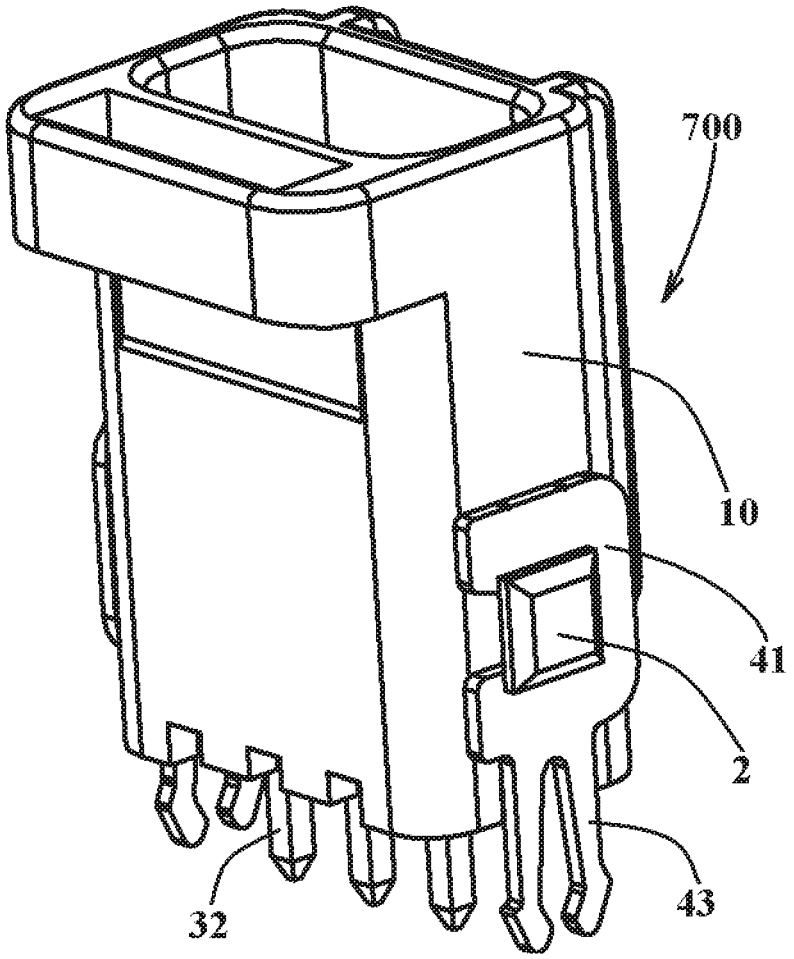
FIG. 15 is a perspective view of the electrical connector in another mounting manner.
Figure 16:
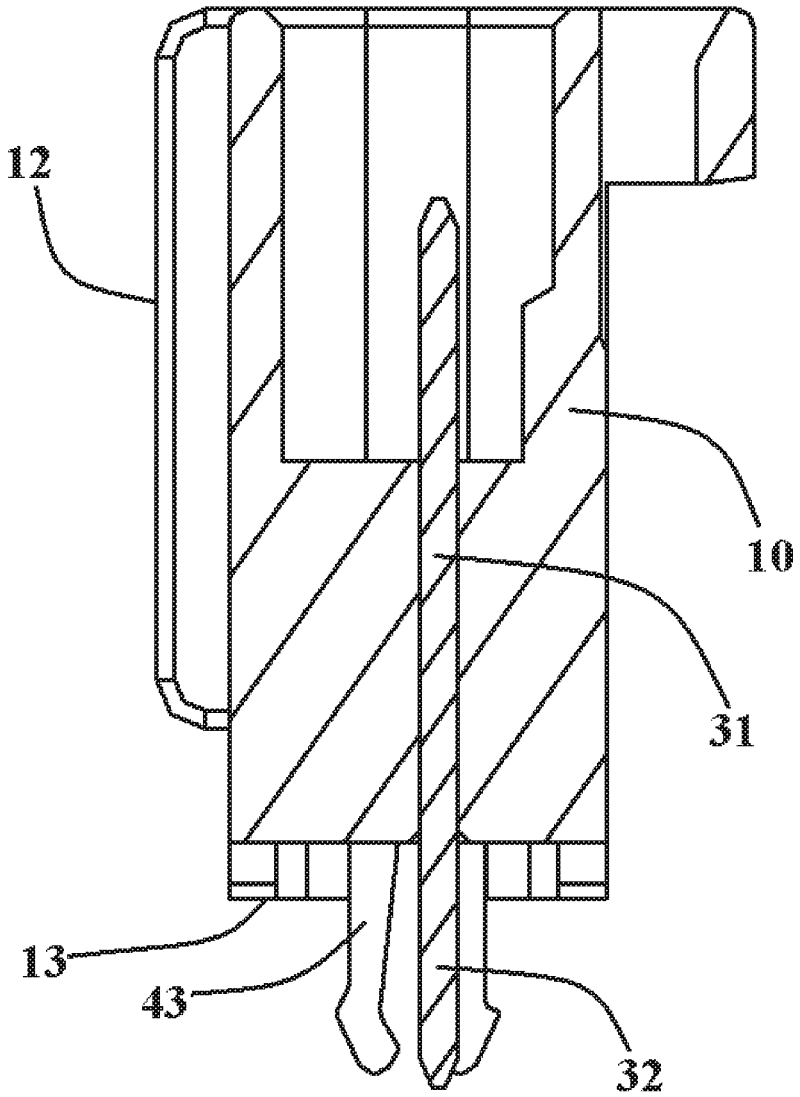
FIG. 16 is a sectional side view of the electrical connector of FIG. 15.
Figure 17:
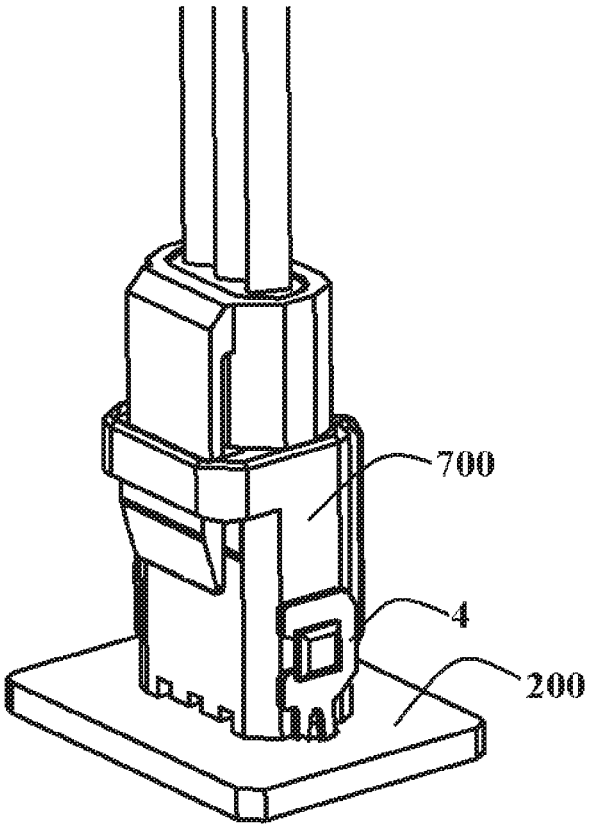
FIG. 17 is a perspective view of the electrical connector of FIG. 15 and the mating connector mounted on a circuit board.
Figure 18:
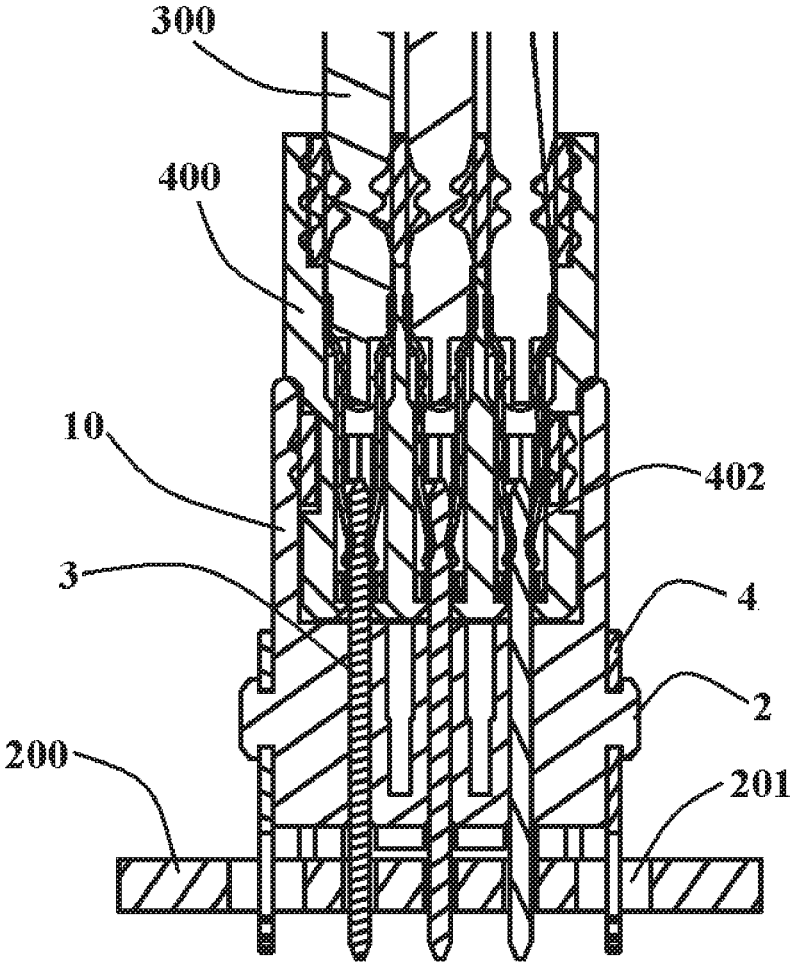
FIG. 18 is a sectional side view of the electrical connector, the mating connector, and the circuit board of FIG. 17.

The electrical connector 600 shown in FIGS. 12-14 is mounted vertically on the circuit board 200 by SMT, the second contact surface 13 of the connector housing 10 is in contact with the circuit board 200. In this mounting embodiment, the connection terminal 3 has a generally L-shape, and the extension 32 of the connection terminal 3 extends out of the connector housing 10 through the grooves 153 in the skirt 152 of the connector housing 10. The extension 32 of each of the connection terminals 3 is soldered to an electrical contact on the circuit board 200 to form an electrical connection with a corresponding mating contact in the circuit board 200. The mounting mechanism 4 includes the surface mounting portion 42 perpendicular to the mating mounting portion 41, the surface mounting portion 42 being soldered to the pad of the circuit board 200 to mechanically mount the electrical connector 600 on the circuit board 200.

The electrical connector 700 shown in FIGS. 15-18 is mounted vertically on the circuit board 200 by DIP technology, the second contact surface 13 of the connector housing 10 is in contact with the circuit board 200. In this mounting example, the connection terminal 3 has a straight line shape, and a free end of the extension portion 32 of the connection terminal 3 is inserted into a terminal insertion hole of the circuit board 200, forming an electrical connection with a corresponding mating contact in the circuit board 200. The insertion portion 43 of the mounting mechanism 4 is inserted into a socket 201 of the circuit board 200 to mechanically mount the electrical connector 700 on the circuit board 200. The insertion portion of the mating connector 400 connected with the cable 300 is inserted into the receiving portion 14 of the electrical connector 700, the mating terminal 402 of the mating connector 400 engages the connection terminal 3 in the receiving portion 14 of the electrical connector 700, forming an electrical connection between the cable 300 and the circuit board 200.

In the connector housing 10 used in the various electrical connectors 100, 500, 600, 700 described above, the connector housing 10 may be mounted on the circuit board 200 via the first contact surface 12 or the second contact surface 13 perpendicular to each other using the same mounting mechanism 4. The electrical connector 100, 500, 600, 700 may be installed in different mounting manners using the same connector housing 10 and the same mounting mechanisms 4. The electrical connector 100, 500, 600, 700 may be mounted vertically or horizontally on the circuit board 200 by SMT, or mounted vertically or horizontally on the circuit board 200 by DIP technology. The versatility of the electrical connector 100, 500, 600, 700 is improved, reducing a manufacturing cost.

What is claimed is:

1. An electrical connector, comprising:

a connector housing including:

a body, an outside surface of the body having a pair of opposite mounting surfaces, a first contact surface, and a second contact surface, the mounting surfaces, the first contact surface and the second contact surface are perpendicular to each other; and a mounting portion disposed on each of the mounting surfaces, a distance between the mounting portion and the first contact surface is equal to a distance between the mounting portion and the second contact surface;

a connection terminal extending into the connector housing in a direction perpendicular to the second contact surface; and a mounting mechanism engaged with the mounting portion and interchangeably mounting the first contact surface of the connector housing on a circuit board or the second contact surface of the connector housing on the circuit board.

2. The electrical connector of claim 1, wherein the mounting portion includes a connection portion connected to the mounting surface at a first end of the connection portion, a distance between the connection portion and the first contact surface is equal to a distance between the connection portion and the second contact surface.

3. The electrical connector of claim 2, wherein the mounting portion includes a holding portion protruding radially outward from a second end of the connection portion opposite the first end of the connection portion.

4. The electrical connector of claim 3, wherein the mounting mechanism includes a mating mounting portion engaging the connection portion and a fixing portion integrally connected with the mating mounting portion and configured to be connected to the circuit board.

5. The electrical connector of claim 4, wherein the fixing portion includes a surface mounting portion extending perpendicular to the mating mounting portion, the surface mounting portion is adapted to be mounted on the circuit board by surface mount technology.

6. The electrical connector of claim 4, wherein the fixing portion includes an insertion portion extending from the mating mounting portion and adapted to be inserted into a socket of the circuit board.

7. The electrical connector of claim 6, wherein a free end of the insertion portion has a laterally projecting blocking portion.

8. The electrical connector of claim 4, wherein the mating mounting portion has an engagement groove with a lateral opening, the engagement groove adapted to receive the connection portion.

9. The electrical connector of claim 8, wherein the engagement groove has a protrusion.

10. The electrical connector of claim 1, wherein the body has a receiving portion adapted to receive an insertion portion of a mating connector, a bottom wall of the receiving portion is parallel to the second contact surface and has a plurality of through holes.

11. The electrical connector of claim 10, wherein the connection terminal includes an insertion portion inserted into the receiving portion through the through holes and an extension portion integrally connected to the insertion portion and configured to be electrically connected to the circuit board.

12. The electrical connector of claim 10, wherein an outside of the bottom wall has a skirt with a plurality of grooves, a free end of the skirt forms the second contact surface.

13. The electrical connector of claim 12, further comprising a plurality of connection terminals, each connection terminal including an insertion portion inserted into the receiving portion, wherein the receiving portion comprises a single opening defined in the body into which the plurality of insertion portions of the plurality of connection terminals are inserted.

14. The electrical connector of claim 13, wherein each of the plurality of connection terminals comprises a straight line shape over its length.

15. The electrical connector of claim 13, wherein each of the plurality of connection terminals comprises a generally Z-shape including:

an extension portion integrally connected to the insertion portion and extending perpendicularly therefrom and parallel to the outside of the bottom wall, the entire extension portion arranged between a first plane defined by the outside of the bottom wall and a second plane defined by the second contact surface, and extending through one of the plurality of grooves of the skirt; and a soldering end extending perpendicularly from the extension portion and configured to be electrically connected to the circuit board.

16. The electrical connector of claim 10, wherein a first side wall of the body has a plurality of protrusions, a free end of each of the protrusions forms the first contact surface.

17. The electrical connector of claim 16, wherein a second side wall of the body opposite the first side wall has an engagement portion defining an opening receiving and engaging with an engagement arm of a mating connector.

18. The electrical connector of claim 16, wherein each of the plurality of protrusions extends along the first side wall of the body from a front wall of the body in a direction toward the bottom wall, the front wall arranged opposite the bottom wall and defining an opening in communication with the receiving portion.

19. An electrical connector, comprising:

a connector housing including:

a body having a receiving opening adapted to receive an insertion portion of a mating connector, an outside surface of the body having a pair of opposite mounting surfaces, a first contact surface, and a second contact surface, the mounting surfaces, the first contact surface and the second contact surface are perpendicular to each other, wherein a bottom wall defining the receiving opening is parallel to the second contact surface and defines a plurality of through holes, an outside of the bottom wall having a skirt with a plurality of grooves, a free end of the skirt forming the second contact surface, wherein a first side wall of the body includes a plurality of protrusions with a free end of each of the protrusions forming the first contact surface and a second side wall of the body opposite the first side wall has an engagement portion defining an opening for receiving and engaging with an engagement arm of a mating connector; and a mounting portion disposed on each of the mounting surfaces, a distance between the mounting portion and the first contact surface is equal to a distance between the mounting portion and the second contact surface;

a plurality of connection terminals, each connection terminal including an insertion portion extending through a respective one of the plurality of through holes in the bottom wall and into the receiving opening in a direction perpendicular to the second contact surface, each of the plurality of connection terminals comprises a generally Z-shape including:

an extension portion integrally connected to the insertion portion and extending perpendicularly therefrom and parallel to the outside of the bottom wall, the entire extension portion being arranged between a first plane defined by the outside of the bottom wall and a second plane defined by the second contact surface, and extending through one of the plurality of grooves of the skirt; and a soldering end extending perpendicularly from the extension portion and configured to be electrically connected to the circuit board; and a mounting mechanism engaged with the mounting portion and interchangeably mounting the first contact surface of the connector housing on a circuit board or the second contact surface of the connector housing on the circuit board.

20. The electrical connector of claim 19, wherein each of the plurality of protrusions extends along the first side wall of the body in a direction toward the bottom wall from a front wall of the body arranged opposite the bottom wall and defining a front end of the receiving opening.

* * * * *